United States Patent [19]

Truc et al.

[11] Patent Number: 4,748,799

[45] Date of Patent: Jun. 7, 1988

[54] SLEEVING SYSTEM

[75] Inventors: James A. Truc, Wayzata, Minn.; Dale E. Laurin, Everett; Donald L. Edwards, Monroe, both of Wash.

[73] Assignee: Pakon, Inc., Minnetonka, Minn.

[21] Appl. No.: 17,056

[22] Filed: Feb. 20, 1987

[51] Int. Cl.[4] ..... B65B 43/12

[52] U.S. Cl. ..... 53/457; 53/266 R; 53/386

[58] Field of Search ..... 53/202, 246, 252, 381 R, 53/382, 386, 457, 468, 266 A, 266 R, 266 C, 459

[56] References Cited

U.S. PATENT DOCUMENTS

| | | | |
|---|---|---|---|
| 2,937,483 | 5/1960 | Engelstein | 53/246 X |
| 3,381,447 | 5/1968 | Ash et al. | 53/386 X |
| 3,579,948 | 5/1971 | Lerner | 53/386 X |
| 3,788,031 | 1/1974 | Florjancic | 53/252 X |
| 3,807,121 | 4/1974 | Mundt et al. | 53/457 X |
| 3,975,888 | 8/1976 | Jones | 53/386 |
| 4,237,678 | 12/1980 | Thompson | 53/266 A X |
| 4,543,771 | 10/1985 | Jensen et al. | 53/266 R X |

OTHER PUBLICATIONS

Brochure: "Sleevers, Sleeving and Other Photo Products for Your Lab!" Crown Photo Systems, Inc., Everett, Washington.

Brochure: Pakon, Inc., Minneapolis, Minnesota.

Brochure: Loersch Corporation, Allentown, PA and Hanns Loersch GmbH & Co., Straelen, Germany.

Catalog: pp. 1 and 29, 20th Century Plastics, Los Angeles, CA.

Specimens: Slide-Holding Sleeves Manufactured by Technodia S.R.L., Zona Industriale 23/B, 36078 Valdagno (VI) Italy.

*Primary Examiner*—Robert L. Spruill

*Assistant Examiner*—Steven P. Weihrouch

*Attorney, Agent, or Firm*—Kinney & Lange

[57] ABSTRACT

An automatic slide sleeving system in which a sleeve containing a plurality of pockets is moved past a rotatable member to which a vacuum is applied thereby drawing the sleeve along with the rotatable member to a position under a movable head where a second vacuum is applied pulling the pocket into an open condition and thereafter through an actuator mechanism, the slides which have been previously moved into position from a slide hopper by a shuttle are moved in to the open pockets by a tongue pusher after which the vacuums are removed and the rotatable member rotated thereby enabling the filled pockets on the sleeve to be collected.

12 Claims, 8 Drawing Sheets

SLEEVING SYSTEM

BACKGROUND OF THE INVENTION

1. Field of the Invention.

The present invention relates to an apparatus and method for insertin a product such as photographic slides into pockets of a sleeve member automatically in a continuous fashion.

2. Description of the Prior Art.

In the film processing industry after slides have been mounted in cardboard or plastic frames they are normally packaged into small boxes for shipping and handling. Usually this packing is accomplished by hand and such boxing techniques are not only costly but the box is rather heavy for mailing and the film cannot be viewed without removing the slides from the box which often results in fingerprint smudges.

SUMMARY OF THE INVENTION

The present invention operates automatically to insert mounted slides into plastic sleeves so as to reduce the handling costs and to provide an attractive as well as light package for shipping or mailing. The plastic sleeves also protect the slide from damage due to fingerprints and other contamination and allow the slides to be visually scanned while in their packages. By arranging the pockets in rows, the sizing of the pockets can be made so that the sheets of slides can be fit into standard size envelopes currently used for mail order and over-the-counter sales. Furthermore, identification of slides for reorders of prints or extra slides may be accomplished by using write on areas of the sleeve or automatic retrieval of slides can be obtained with machinery that reads characters applied onto the sleeving pockets.

DETAILED DESCRIPTION OF THE PREFERRED EMBODIMENTS

Figure 1:
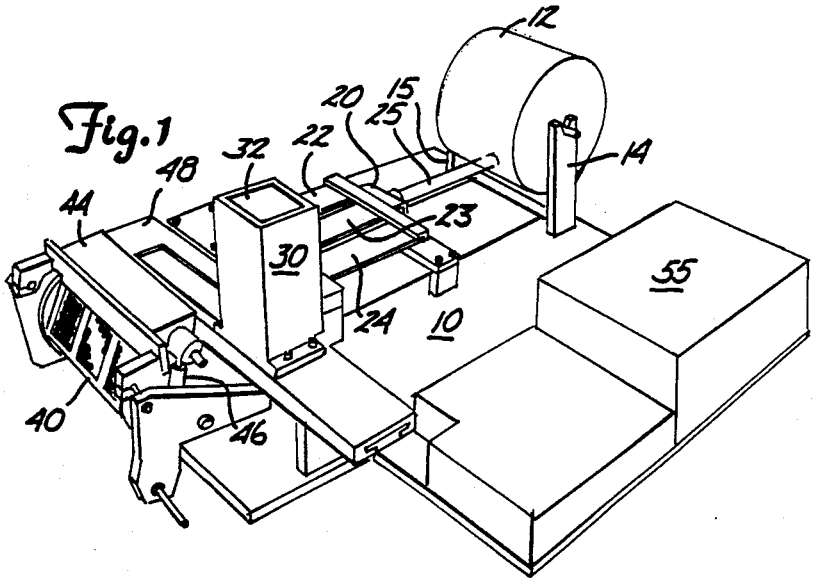
FIG. 1 is a perspective view of a preferred embodiment of the present invention.

Referring to FIG. 1, a perspective view of the apparatus of the present invention is shown, mounted on a base member 10 and comprising the following major elements:

(1) a roll 12 of sleeve material to be described in connection with FIG. 9, mounted for free rotation on a pair of upright members 14 and 15 extending upwards from the base 10;

(2) a tongue member 20 comprising three pusher tongues 22, 23 and 24 extending towards the left and an actuator member 25 extending toward the right. The tongue member 20 will be better described in connection with FIGS. 2, 3 and 8;

(3) a vertical hopper 30 adapted to contain a pile of mounted photographic slides 32 or other similar products which are to be inserted into the pockets on the sleeve material 12;

(4) a multi-sided rotatable member or drum 40 which will better be described in connection with FIGS. 2 and 4, for pulling and positioning the sleeve material from roll 12 through the apparatus while the slides are being inserted;

(5) a lifter head 44 operated by actuating mechanism 46 to open the pockets in the sleeve material 12 while such sleeve material is being held by the rotatable member 40 so that that slides may be inserted. The lifter head 44 will be better described in connection with FIGS. 2, 3, 4 and 5;

(6) a shuttle member 48 to be better described in connection with FIGS. **6, 6*a* and 7 operable to move slides from the hopper 30 into a position where the pusher members 22, 23 and 24 can move the slides into the pockets open between rotatable member 40 and lifter head 44**;

(7) a pneumatic actuator assembly 52 operable to control the actuation of the vacuums and various actuators causing motion of the elements of the present invention; and (8) a control assembly 55 which may include a computer and timer for determining the proper actuating times and positions for the elements of the present invention.

The sleeve material 12 may be of the type manufactured and sold by the Unicolor Division of Protosystems Inc. and identified as slide album pages. The vacuum sources and the pneumatic actuator in the assembly 52 may be any standard vacuum and air compressor. The controller 55 may be a programmable logic controller such as that manufactured and sold by Crouzet Inc. as Model Number CMP 31.

In operation the rotatable drum 40 is connected to the assembly 52 in such a way that a vacuum is applied to two surfaces of the several-faced drum, and more particularly, to that surface which first receives the sleeve material 12 and that surface which lies adjacent the lifter head 44.

As the sleeve material from roll 12 passes over to the drum 40, a vacuum applied to the interior of the drum acting through a plurality of holes in the surface operates to hold the sleeve material onto that surface of the drum. As the drum 40 rotates, the sleeve material is carried along and is brought up to a position just underneath the lifter head 44. A second vacuum is applied from assembly 52 to the lifter head 44 so as to pull the upper surface of the sleeve material thereagainst. The actuator 46 thereafter lifts slightly thus opening the pocket in the sleeve material for insertion of the slides.

During this time, the shuttle 48 moves under the hopper 30 to receive one or more slides at spaced positions along the shuttle 48. Thereafter, the shuttle 48 is moved back to the position shown, and the three slides are lying in a position adjacent the openings of the pockets in the sleeve material between drum 40 and lifting head 44. At this time, actuator 25 is actuated moving the pusher tongues 22, 23 and 24 against the slides and pushing them into the open pockets on the sleeve material. The controller 55 then causes the actuator 46 to move the lifter 44 away from the sleeve material. The drum 40 then rotates to another position where the next row of pockets is now inserted between the drum 40 and the lifter head 44 while the filled row is released by cessation of the vacuum so that the sleeve is removable from the drum 40 for storage packing or mailing.

Figure 2:
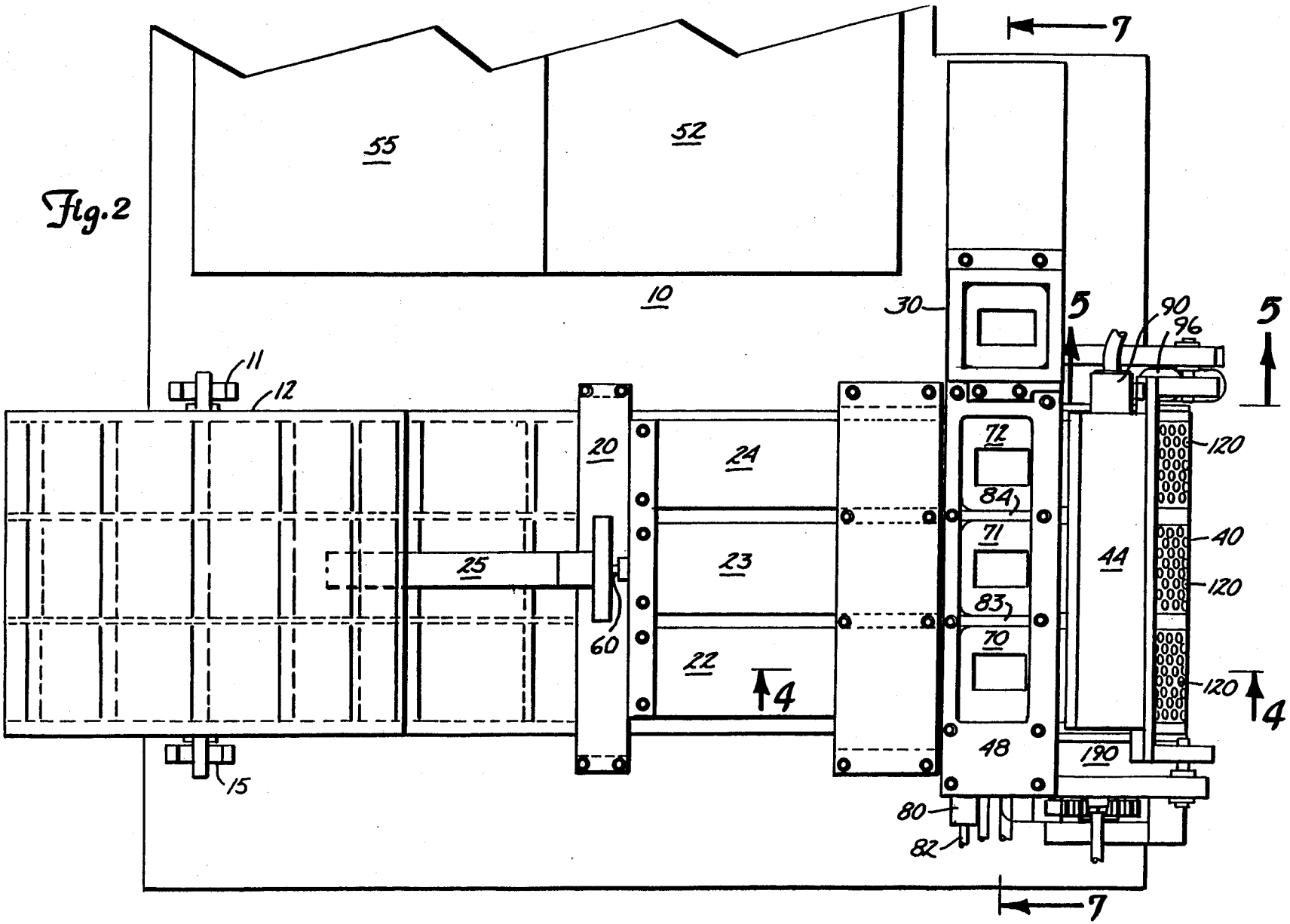
FIG. 2 is a top view of a portion of FIG. 1.

Referring now to FIG. 2 wherein elements that are shown in FIG. 1 have the same reference numerals, a top view of FIG. 1 is seen with the roll 12 of sleeve material shown supported by the upright members 14 and 15. The tongue member 20 and the three pusher tongues 22, 23 and 24 are shown connected to the actuator 25 by an actuator piston 60. Three slides are shown in the shuttle 48 identified by reference numerals 70, 71 and 72 and they are seen to be located in the paths of the pusher tongues 22, 23 and 24, respectively. It will be understood that when the actuator member 25 is energized from the pneumatic actuator assembly 52 the piston 60 will cause the tongue pushers 22, 23 and 24 to move to the right thereby pushing the slides 70, 71 and 72 to the right to a position under the lifter head 44 and into the open pockets on the sleeve material coming from roll 12.

Figure 7:
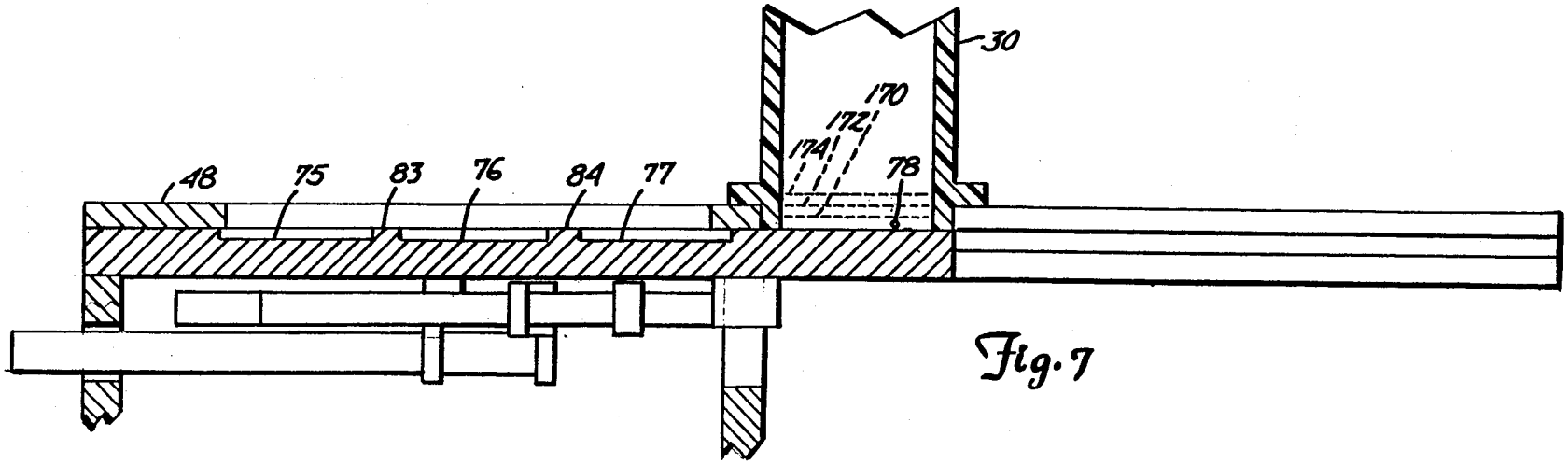
FIG. 7 is a cut away front view of FIG. 2 taken along section 7—7.

Slides 70, 71 and 72 are shown contained in the shuttle 48 in three receiving areas, better shown in FIG. 7 as receiving areas 75, 76 and 77, respectively. Shuttle member 48 is actuated by a pneumatic actuator 80 having a pneumatic connection 82 which is connected to the pneumatic actuator assembly 52. After the slides 70, 71 and 72 are pushed to the right and into pockets on the sleeve material 12, actuator 25 operating through piston 60 withdraws the pusher tongues 22, 23 and 24 to the left, as shown in FIG. 2, at which time the empty shuttle 48 will be actuated by pneumatic actuator 80 to move upwardly in FIG. 2 underneath the hopper 30 for receipt of further slides.

More particularly in FIG. 7, a sensor 78 in hopper 30 senses a slide at the bottom position and notifies the control assembly which then actuates the shuttle 48 and moves it to where the slide at the bottom of the pile at hopper 30 will move into the receiving area 77 occupied by slide 72 in FIG. 2. The sensor 78 in hopper 30 then senses another slide positioned at the bottom and notifies the control assembly 55. Further motion of shuttle 48 results causing the next slide in the pile to fall into the receiving area 76 occupied by slide 71 in FIG. 2. The sensor 78 in hopper 30 again senses a slide positioned at the bottom and again notifies the control assembly 55. Thereafter further motion of the shuttle will result allowing the third from the bottom slide in hopper 30 to move into receiving area 75 occupied by slide 70 in FIG. 2. Actuator 80 will now move the shuttle 48 back to the position shown in FIG. 2 for the next operation. If sensor 78 detects the absense of a slide, the control assembly is notified and the process is halted until an operator either overrides the system or adds more slides to hopper 30. The sensor 78 may be an electrical or pneumatic switch located at the side of hopper 30 as shown as at the bottom looking up.

It should be noted that the receiving areas 75, 76 and 77 of FIG. 7 are separated from one another by abutments 83 and 84, respectively, which abutments are also shown in FIG. 2 in or about the sensing area. Small switches activated by the slide may be employed in the receiving areas instead of in the hopper if desired.

FIG. 2 also shows the pneumatic actuator 46 operable to move lifter head 44 both upward to open a sleeve pocket and upward and away from the rotating drum 40 as the sleeve material 12 moves into a position to receive slides from shuttle 48. A vacuum connection 90 is shown in FIG. 2 which supplies the vacuum in lifter head 44.

Figure 3:
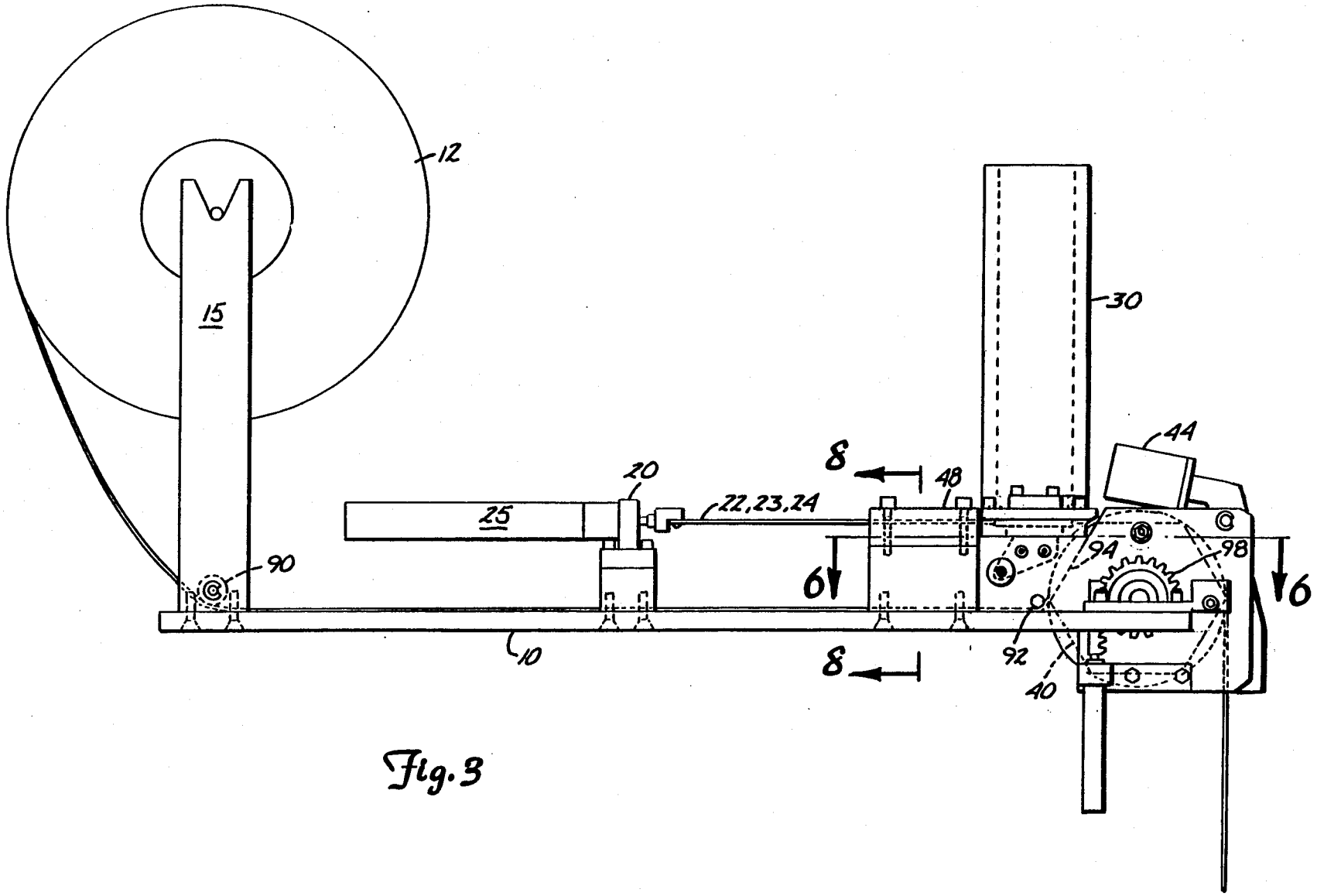
FIG. 3 is a side view of FIG. 1.
Figure 11:
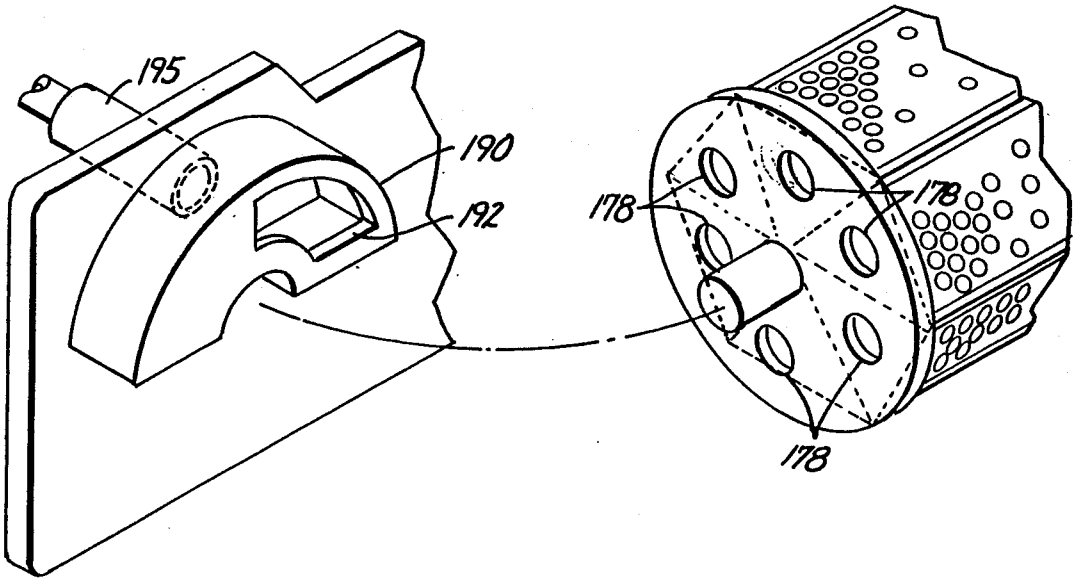
FIG. 11 is an exploded view of rotating drum and vacuum manifold therefore.

In FIG. 3, which is a side view of FIG. 1, the elements which have been previously provided with reference numerals will have the same reference numerals. In FIG. 3 the roll of sleeve material 12 is shown mounted for free rotation on the upright member 15 and the sheet of sleeve material is fed from the roll 12 down around a guide roller 90 and then fed along the base 10 under the actuator 25, tongue member 20 and tongue pushers 22, 23 and 24, under the actuator 48 and a second guide roller 92 to one of the sides 94 of the rotatable drum 40 shown as a dashed line hexagon in FIG. 2. The sheet of sleeve material will be brought up along the surface of side 94 and a vacuum, which will be better described in connection with FIG. 11 is applied to the interior of the drum 40 so as to cause the sheet of material to be pressed against side 94. Thereafter, through a motor drive controlled by controller 55 and through a one-way clutch and gear 98, the drum 40 is rotated in a clockwise direction thereby drawing the sheet of sleeve material into a position lying directly under the lifter head 44.

Figure 9:
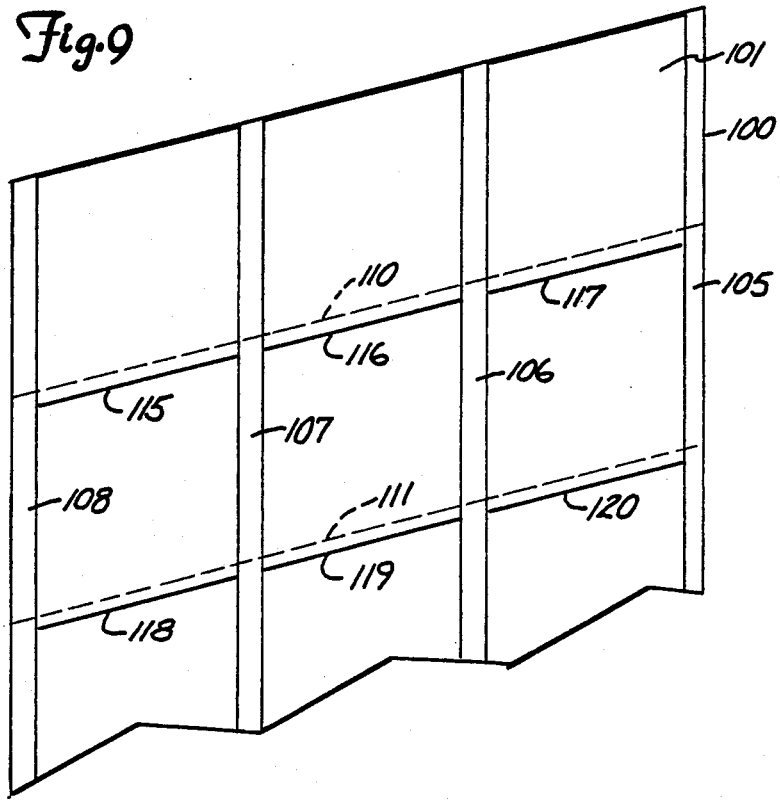
FIG. 9 is a perspective view of the sleeve material and pockets therein.

Referring for a moment to FIG. 9, a sheet of sleeve material is shown in more detail. In FIG. 9, the material is shown to comprise a first or base piece of material such as plastic 100 having a second piece 101 atop thereof and sealed as by heat to the base continuously along areas such as shown as lines 105, 106, 107 and 108. The upper sheet material 101 is also sealed to the lower sheet 100 along lines such as shown by dashed lines 110 and 111. While two separate sheets have been shown in FIG. 9, the upper sheet 100 and the second sheet 101 may be the same piece of material folded over on itself.

As thus described so far, this would form a plurality of closed rectangular areas on the sleeve material. The upper material 101 is then cut along lines such as shown by reference numerals 115, 116, 117, 118, 119 and 120 so as to provide an access to the interior of the rectangles thus formed by the heat sealing. It is preferred that only the upper surface 101 be cut so as to provide a better container for the slides but some manufacturers may prefer to cut through both the sheets 100 and 101 for ease in manufacture, and such arrangement is acceptable for use with the present invention.

As seen, the sleeve material on roll 12 will consist of a plurality of rows of pockets each consisting of three pockets. While three pockets are shown in connection with FIG. 9, it should be understood that any number of pockets could be used, and there is no intention to limit the present disclosure to the use of three pockets per row. There is an advantage which accrues to the use of three pockets, however, in that the size of the slides is normally two inches by two inches and thus three slides side-by-side occupy a length that is approximately six inches. Two of these rows therefore form an area approximately six inches by four inches and after the slides have been injected into the pockets, they may be cut or folded into combinations approximately four inches by six inches so as to accommodate the standard size envelopes used to house photographic positives that are four by six inches in size. This enables ease in packaging and mailing without having to convert to specialized packages.

Referring once again to FIG. 2, it is seen that the drum 40 contains a plurality of small holes such as identified by reference numerals 120 in the outer surface thereof. As will be explained below, a vacuum is applied to the interior of drum 40 which operates through the holes 120 to pull the lower surface 100 of the sleeve material against one of the sides of the drum. Thereafter as the drum rotates, the sleeve material is pulled along until it reaches a position where no vacuum is applied and it is thereafter released. During the course of its travel it passes underneath the head 44 where the head 44 is lowered and a vacuum applied so as to pull the upper surface 101 of the sleeve material upwardly a slight distance thereby opening the pocket and allowing the slides such as 70, 71 and 72 to be pushed into these pockets by the tongue pushers 22, 23 and 24.

As seen in FIG. 3, after the slides have been entered into the pockets on the sleeve material, the sleeve material exits the system under the force of gravity and is shown at the right of FIG. 3 extending downwardly to be cut or collected as desired.

Figure 5:
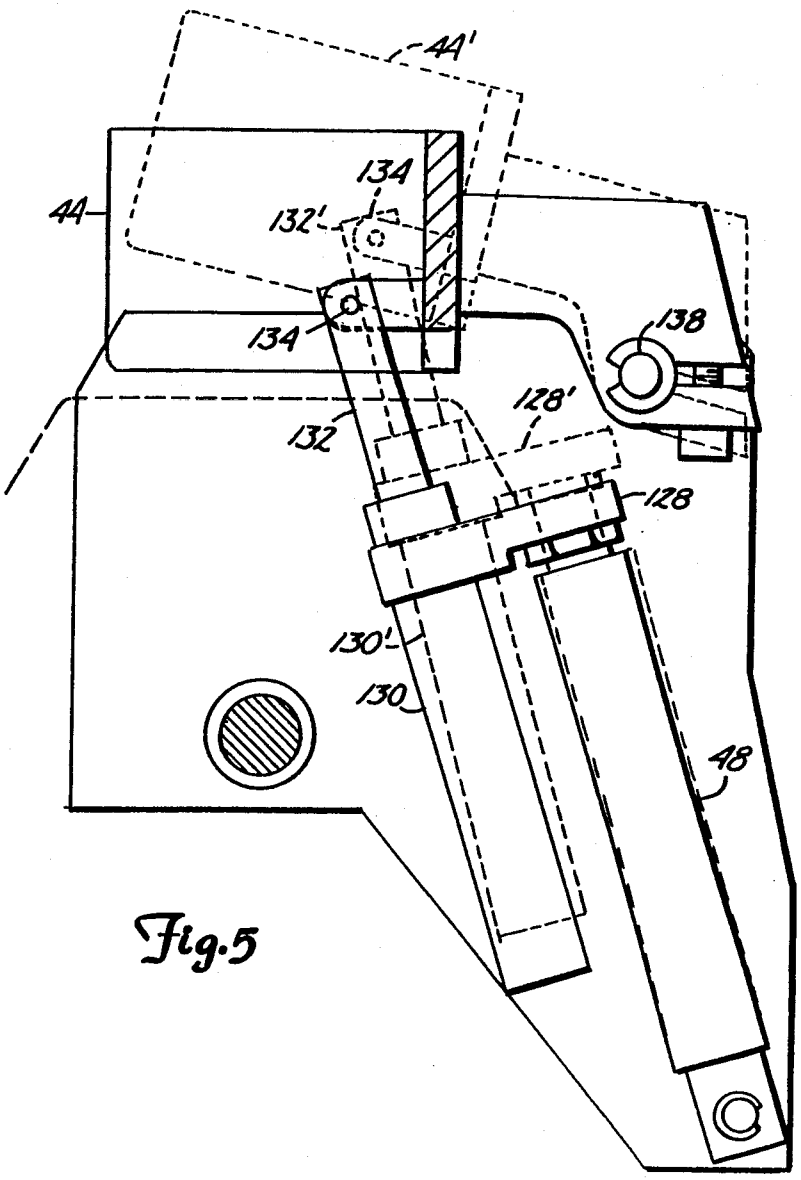
FIG. 5 is a cut away side view of FIG. 2 taken along section 5—5.

A more detailed view of the lifter head 44 can be found in FIG. 5. In FIG. 5 the lifter head 44 is shown in two positions, the solid line position being the position in which it holds the plastic material open for insertion of the slides. After the slides have been inserted, a pneumatic actuator shown in solid lines by reference numeral 48 operates through a linkage consisting of member 128 connected to a second actuator 130 which contains a piston 132 connected to the head 44 at a pivot point 134. There may be a third position (not shown) where the lifter head is lower than shown by solid line position 44 and is in contact with the sleeve material. This position is used to assure that the lifter head 44 will in fact capture the upper material of the pocket. After touching and capturing the upper material, actuator 130 is actuated and piston 132 raises the upper material slightly to open the pocket. After filling the pocket, actuator 48 is then actuated. When actuator 48 is energized by pneumatic pressure from pneumatic controller 52, member 128 will be moved upwardly to the position shown by dashed line 128' and actuator 130 will be moved to a position shown by dashed line 130'. This causes the piston 132 to occupy a position shown by dashed line 132' and it is seen that pivot point 134 is now moved to a point 134' which causes rotation of lifter head 44 around a pivot 138 to a position shown as dashed line 44'. During this motion, the vacuum is overcome and the upper sheet of material released to close the pocket. The lifter head 44 will then be out of contact with the sheet material thereby allowing the drum 40 to rotate another set of pockets into position. Head 44 will then again be lowered to contact position (not shown) and the process is repeated.

Figure 6:
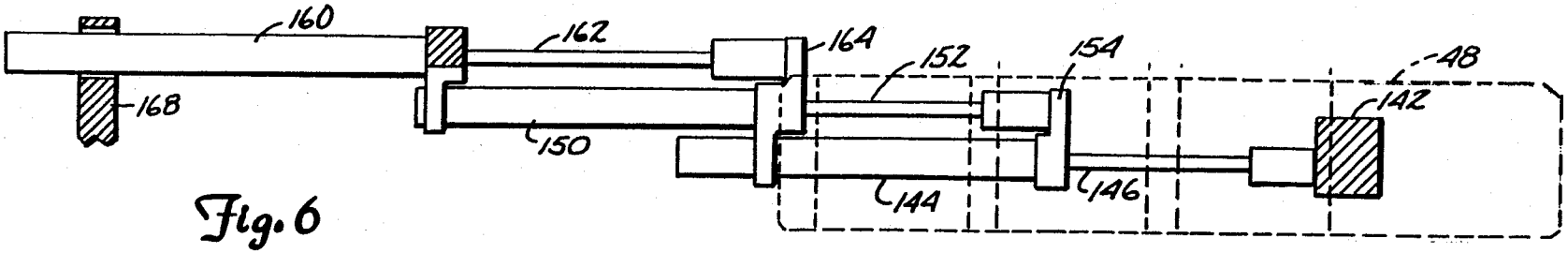
FIGS. 6 and 6A are a cut away top view of FIG. 3 taken along section 6—6.
Figure 6A:
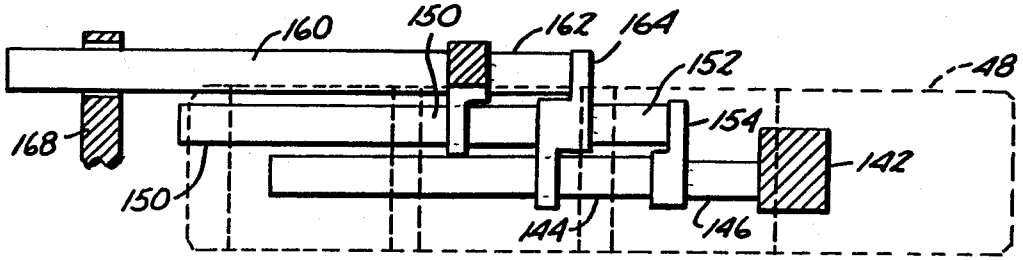

Further details of the shuttle actuator are seen in FIGS. 6 and 6*a*. In FIG. 6, the shuttle 48 is shown in dashed lines connected by a connection shown as cross-hatched area 142 to a first pneumatic actuator 144 having a piston 146. Actuator 144 is also shown connected to a second actuator 150 having a piston 152 bearing against a vertically extending abutment 154 connected to actuator 144. Actuator 150 in turn is connected to a third actuator 160 having a piston 162 which bears against a vertical abutment 164 connected to actuator 150 and to actuator 144. Actuator 160 is guided by a support member 168 to guide it in motion to the right and left.

When all of the actuators are deactuated, i.e. all retracted to the left, the shuttle 48 will occupy the position shown in FIG. 6*a* which corresponds to the position shown in FIG. 2. In order to have the shuttle 48 move under the hopper 30 and receive the slides one at a time, actuator 144 is first actuated by a signal from sensor 78 and the controller 55 operates through the pneumatic actuator 144 to push the piston 146 to the right and thus carry the shuttle 48 to a first position determined by the length of piston 146. This will then lie in a position to receive a first of the slides, i.e. slide 170 of FIG. 7, into area 77.

When this has been accomplished, switch 78 signals the controller 55 that another slide is ready and actuation of actuator 150 results which moves piston 152 to the right thereby carrying actuator 144 and shuttle 48 a further distance to the right determined by the length of piston 152. This will position area 76 of FIG. 7 under the hopper 30 and will allow a second slide, i.e. slide 172, to fall into the area 76. Thereafter switch 78 signals controller 55 that another slide is ready and actuation of actuator 160 results which causes piston 162 to move to the right carrying with it actuator 150 and actuator 144 thus moving shuttle 48 a further distance to the right determined by the length of piston 162 sufficient to bring area 75 in FIG. 7 underneath the hopper 30 and allow a third slide, i.e. slide 174, to drop into the area 75. Thereafter the pneumatic actuators are caused to reverse and the shuttle 48 moves back into the position such as is shown in FIG. 2 with the three slides now in position for insertion into the pockets when called for.

Figure 4:
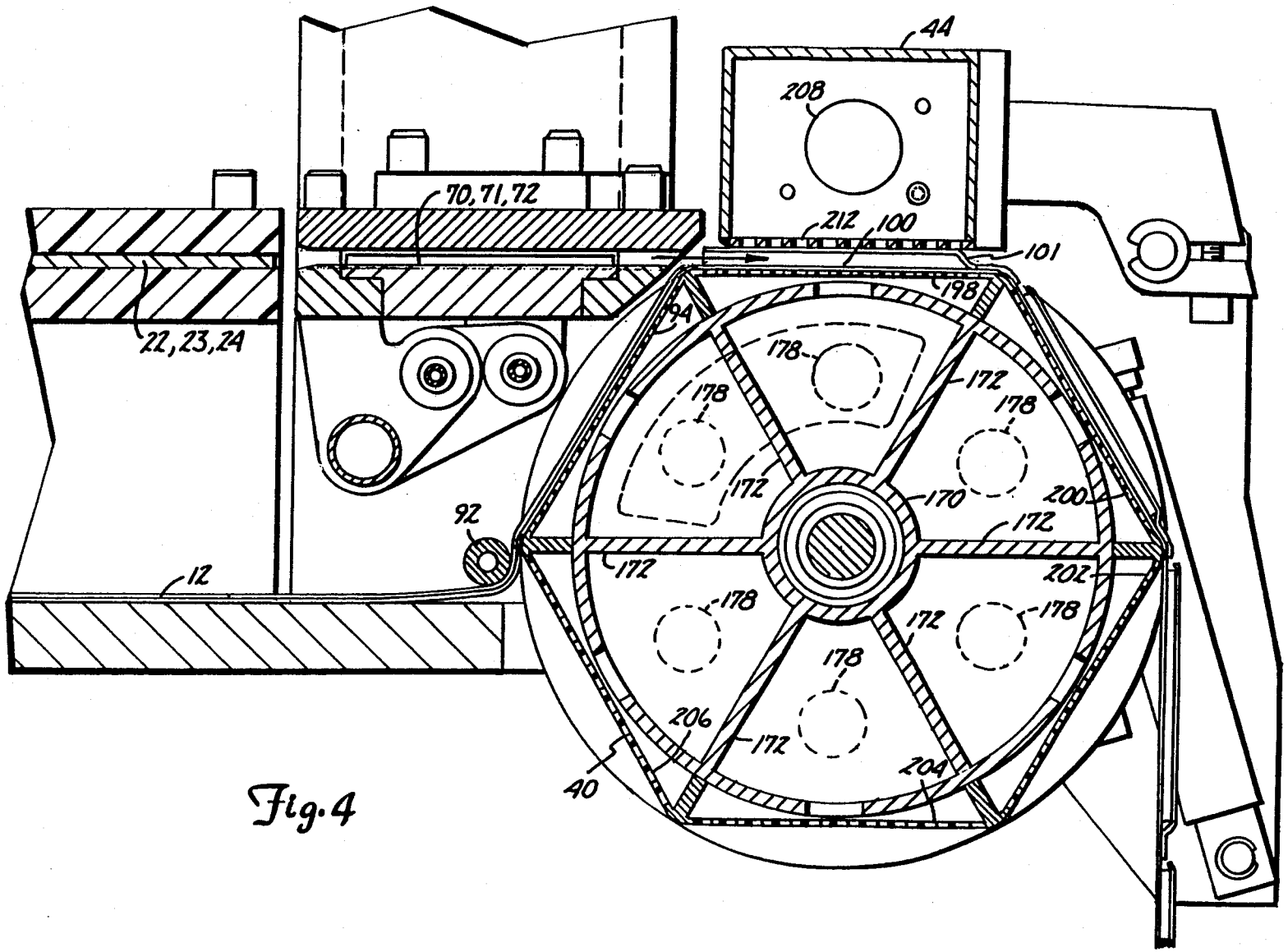
FIG. 4 is a cut away side view of FIG. 2 taken along the Section 4—4.

FIG. 4 shows further detail of rotatable drum 40 of FIGS. 1, 2 and 3. In FIG. 4, the drum 40 is again shown as a hexagon and the sleeve material 12 is shown, as with FIG. 3, passing under guide 92 and onto the surface 94. Drum 40 has a plurality of partitions extending from the central hub 170 thereof outwardly to the edges of the hexagon by walls 172. This divides the interior of the drum into six compartments of roughly triangular shape. The ends of the drum are sealed but, as better seen in FIG. 11, a plurality of holes 178 are formed in one end leading to each of the triangular chambers.

An end member or manifold 190 is seen in FIG. 11, as approximately semi-circular in configuration and contains an aperture 192 large enough only to uncover two of the end holes 178, i.e. the two leading to chambers in the upper left and upper portions of drum 40 in FIG. 4. The manifold 190 fits over the end of drum 140 around the central shaft and a pneumatic connection to the manifold 190 is shown by reference numeral 195 which applies a vacuum to the interior of the manifold 190 which can only escape through the opening 192. Since this is only applied to two of the apertures 178, it is only those two triangular volumes of the rotatable member 40 that are exposed to the vacuum. Thus, there will be a pressure exerted on the sleeve material 12 against surface 94 and against a surface 198 in FIG. 4, but no pressure applied to surfaces 200, 202, 204 or 206. Thus, the underside of the sleeve material 12 will be held against surfaces 94 and 198, but not against the others.

The lifter head 44 has a substantially square interior to which a vacuum is applied through a port 208 from the connection shown as 90 in FIG. 2. This vacuum applies itself through apertures such as 212 in the head member 44 so as to pull the upper sheet member 101 away from the lower sheet member 100 to form a pocket as seen in FIG. 4. After this pocket is opened, the slides which are shown in FIG. 4 as with reference numeral 70, 71 and 72 are pushed to the right by the tongue pushers shown in FIG. 4 by reference numerals 22, 23 and 24. The slides therefore enter the area between sheet 101 and 100 and thereafter the tongue members 22, 23 and 24 are withdrawn to the left in FIG. 4.

Head 44 is now rotated upwardly as described in connection with FIG. 5 away from the now-filled pocket in sleeve member 12 and drum 40 can now be rotated in a clockwise direction so that the filled pockets will move to a position shown by surface 200 where the vacuum is released from the interior chamber of the drum 40. Now, under the pull of gravity, the sleeve will be lowered to a receiving station not shown.

Figure 8:
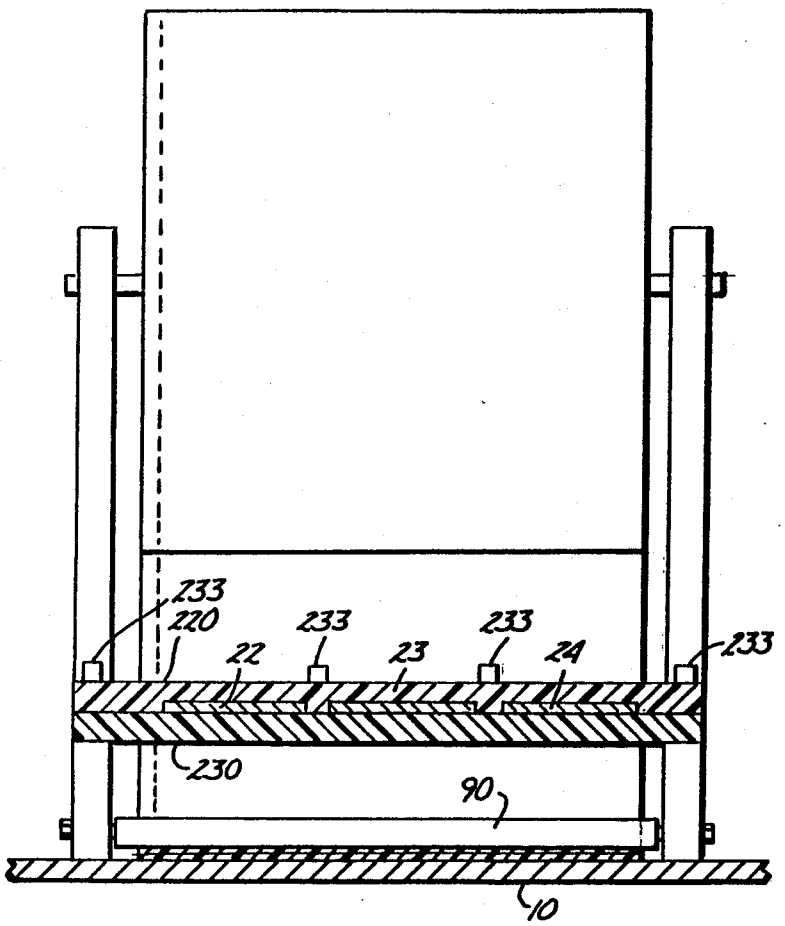
FIG. 8 is a cut away front view of FIG. 3 taken along section 8—8.

FIG. 8 shows a more detailed cross sectional view of the tongue actuator 20 wherein it is seen that the pusher tongues 22, 23 and 24 are guided in their movement to the right in FIG. 3 by two guide members 220 and 230 fastened together by bolts 233 so as to form rectangular slots for the tongue pushers 22, 23 and 24 to slide in.

Figure 10:
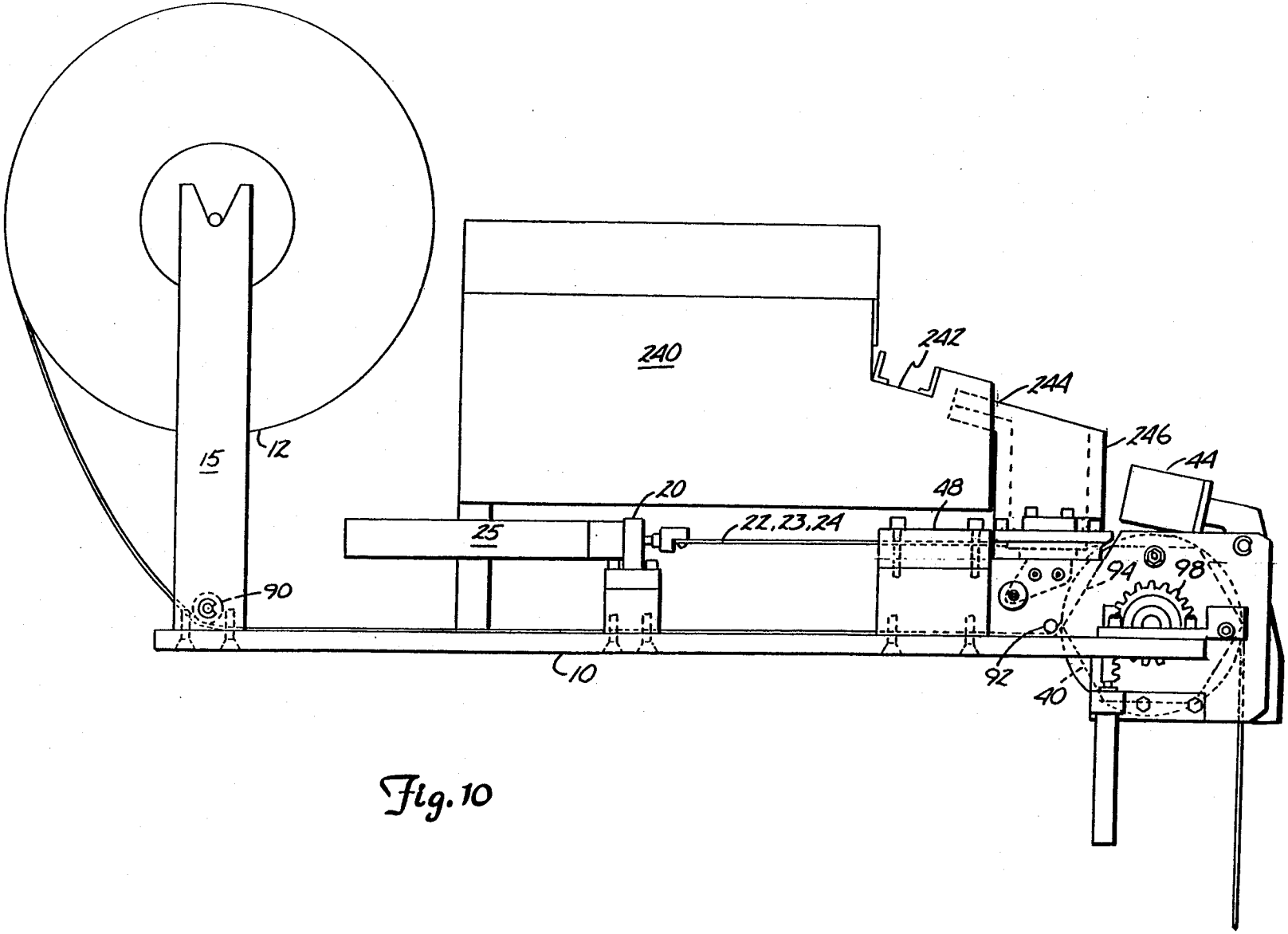
FIG. 10 is a side view of FIG. 1 showing a mounter and an alternate form of hopper useful to combine the present invention automatically with the output of the mounter.

Finally referring to FIG. 10, a second side view of the apparatus is shown similar to that in FIG. 3, but in FIG. 10, a slide mounter apparatus 240 which may be the slide mounter Model SA101 manufactured and sold by Pakon, Inc. is shown connected to the present invention as might be the case in actual practice. The mounter operates to mount slides in their cardboard or plastic containers and produce them as an output at a channel 242 which is shown leading to a slide chute 244 and into a feed hopper 246 shaped to receive the output of mounter 240 and seen to be in slightly different form than that of hopper 30 in FIG. 3. The remainder of the apparatus in FIG. 10 is like that shown in FIG. 3 and will not be furthered described.

It is therefore seen that I have provided a novel and unique method for packaging slides into plastic sleeves which is both economical and simple in its construction and provides inexpensive, light-weight and easy to view containers. Many obvious modifications will occur to those skilled in the art, as for example the drive mechanisms, while shown to be pneumatic could be mechanical and the various forms assumed by the various parts, such as the hexagonal shape for the drum, could be in other shapes, or the mounting mechanisms could all be done in other obvious ways found in the art. Accordingly, I do not wish to be limited to the specific disclosures used in connection with the preferred embodiments. I intend only to be limited by the following claims.

What is claimed is:

1. An automatic system for inserting products into sleeve means which has first and second portions of material fastened together to form a plurality of spaced pockets comprising:

a rotatable member having a plurality of sides;

drive means for rotating said member from a first position to a second position and to a third position;

first force producing means connected to said rotatable member to produce a force adjacent a first side when the first side is in the first position, the force operable to pull the first portion of material of said sleeve means against the first side so as to pull the the plurality of pockets so that a first pocket is brought to the second position as the rotatable member rotates;

second force producing means mounted adjacent the second position operable when the first side and the first pocket have reached the second position to pull the second portion of material away from the first portion of material so as to open the first pocket; and inserting means operable when the first pocket is open to insert a desired product into the first pocket, the second force producing means thereafter releasing the second portion of material to close the pocket on the product and the drive member thereafter rotating the rotatable member to pull the plurality of pockets so that the first pocket is brought to the third position where the first force producing means is released so that the first pocket is removable from the rotatable member.

2. Apparatus according to claim 1 wherein the first and second force producing means are first and second vacuum producing means, respectively.

3. Apparatus according to claim 2 further including control means operable to control the rotation of the rotatable member, to control the operation of the first and second vacuum producing means, to control the inserting means to produce a timed sequence for rotating the rotatable member, opening the pocket, inserting the product into the pocket, releasing the vacuums and rotating the filled pocket to the third position.

4. Apparatus according to claim 2 wherein the product is a photographic slide and the second portion of material is translucent plastic to allow viewing of the slides in the pockets.

5. Apparatus according to claim 4 wherein the sleeve means is an elongated sheet, and the first and second portions of material provide the plurality of spaced pockets, the rotatable member operating to pull the sleeve means continuously so that successive pockets are moved by the rotatable member to the first position for attraction by the first vacuum producing means, to the second position for opening and filling the pockets and to the third position for releasing the filled pockets.

6. Apparatus according to claim 5 wherein the sleeve means is mounted on a roll and is drawn from the roll by the rotating of the rotatable member.

7. An automatic system for inserting a photopraphis slide into sleeve means in the form of an elongated sheet with first and second portions of material fastened together to form a plurality of spaced pockets, the second portion of material being translucent plastic to allow viewing of the slides in the pockets, comprising:

a rotatable member having a plurality of sides;

drive means for rotating said member from a first position to a second position and to a third position;

first vacuum producing means connected to said rotatable member to produce a force adjacent each side when such side is in the first position, the force operable to pull the first portion of material of said sleeve means against such side so that the rotatable member operates to pull the sleeve means continuously and successive sides and associated pockets are moved by the rotatable member to the first position for attraction by the first vacuum producing means, to the second position for opening and filling the pockets and to the third position for releasing the filled pockets;

second vacuum producing means mounted adjacent the second position operable when each side and associated pocket have reached the second position to pull the second portion of material away from the first portion of material so as to open each successive pocket;

inserting means operable when each pocket is open to insert a photopraphic slide into such pocket, the second vacuum producing means thereafter releasing the second portion of material to close such pocket on the slide and the drive member thereafter rotating the rotatable member to the third position where the first vacuum producing means is released so that the pockets are successively removable from the rotatable member;

a hopper for receiving a plurality of slides;

a reciprocal member having a receiving area and movable from a first position to a second position, the receiving area of the reciprocal member in the second position receiving a slide from the hopper, the reciprocal member then returning with the slide to the first position; and a tongue member having a pusher operable when the reciprocal member is in the first position to push the slide from the receiving area into the opened pocket of the sleeve each time the rotatable member is in the second position and the second vacuum producing means has opened the pocket.

8. Apparatus accordingly to claim 7 further including control means operable to control the rotation of the rotatable member, to control the operation of the first and second vacuum producing means, to control the inserting means, to produce a timed sequence for rotating the rotatable member, opening the pocket, inserting the slide into the pocket, releasing the vacuums and rotating the filled pocket to the third position.

9. Apparatus according to claim 7 further including switch means mounted proximate said hopper for sensing the existance of a slide at the bottom thereof and controlling the reciprocal member accordingly.

10. Apparatus according to claim 7 wherein the pockets on the sleeve means are at least three abreast and the reciprocal member has at least three receiving areas to receive at least three slides from the hopper and the tongue member has at least three pushers to push the slides into the pockets simultaneously.

11. Apparatus according to claim 10 wherein the sleeve means is mounted on a roll and is drawn from the roll by the rotating of the rotatable member.

12. The method of packaging a slide in a pocket of a sleeve having a plurality of pockets comprising the steps of:

(1) placing the sleeve against a rotatable member in a first position adjacent a first vacuum source;

(2) applying a vacuum from the first source to one side of a first pocket to hold it against the rotatable member;

(3) rotating the member to pull the sleeve to a second position to place the first pocket adjacent a second vacuum source;

(4) applying a vacuum from the second source to the other side of the first pocket to open the first pocket;

(5) moving the product into the open pocket;

(6) releasing the second vacuum to close the pocket on the product; and (7) rotating the member to pull the sleeve to a third position and removing the vacuum from the first source to release the first pocket from the rotatable member.

* * * * *